US010494826B1

(12) United States Patent
Wheatley

(10) Patent No.: US 10,494,826 B1
(45) Date of Patent: Dec. 3, 2019

(54) METHOD OF REPAIRING CRACKED CONCRETE

(71) Applicant: Donald E. Wheatley, Holland, MI (US)

(72) Inventor: Donald E. Wheatley, Holland, MI (US)

( * ) Notice: Subject to any disclaimer, the term of this patent is extended or adjusted under 35 U.S.C. 154(b) by 0 days.

(21) Appl. No.: 16/137,229

(22) Filed: Sep. 20, 2018

(51) Int. Cl.
*E04G 21/00* (2006.01)
*E04G 23/02* (2006.01)

(52) U.S. Cl.
CPC ..... *E04G 23/0211* (2013.01)

(58) Field of Classification Search
CPC . E04G 23/02; E04G 23/0214; E04G 23/0211; E04G 2023/0251; E04G 23/0207; E04G 23/0203; E04G 23/0218; E01C 7/147; F16L 13/11
USPC ..... 52/741.1, 742.1, 742.12, 514, 393
See application file for complete search history.

(56) References Cited

U.S. PATENT DOCUMENTS 3,581,631 A * 6/1971 Samson ..... B32B 27/00 156/337
5,649,398 A * 7/1997 Isley, Jr. ..... E04C 5/07 24/304
5,771,557 A * 6/1998 Contrasto ..... E01C 7/147 264/36.2
6,405,508 B1 * 6/2002 Janesky ..... E04G 23/0214 52/741.4
6,532,714 B1 * 3/2003 Ferm ..... E01C 7/147 404/64
6,692,595 B2 2/2004 Wheatley et al.
7,743,585 B2 6/2010 Wheatley
7,823,354 B2 11/2010 Wheatley
8,567,146 B2 * 10/2013 Hemphill ..... E04G 23/0218 52/514.5
9,528,286 B2 12/2016 Wheatley
2007/0050963 A1 * 3/2007 Keller ..... B23P 6/04 29/402.12
2009/0081913 A1 3/2009 Wheatley
2009/0263572 A1 10/2009 Wheatley
2014/0248460 A1 * 9/2014 Taverne ..... C04B 41/53 428/63
2015/0300033 A1 * 10/2015 Weber ..... E04G 23/0214 52/514
2016/0102457 A1 4/2016 Wheatley

* cited by examiner

*Primary Examiner* — Chi Q Nguyen
(74) *Attorney, Agent, or Firm* — Harness, Dickey & Pierce, P.L.C.

(57) ABSTRACT

A method of repairing concrete having a crack, including cutting an elongated slot across the crack. Inserting an elongated rigid grid into the slot to extend across the crack, the rigid grid having a length dimension greater than a width dimension which is greater than a thickness dimension, the rigid grid defining a plurality of openings there through that extend toward opposites sides of the slot; and adhering the elongated rigid grid in the slot with an adhesive that flows into at least some of the plurality of openings. The rigid grid can be formed from a rigidified fabric grid, a wire mesh, or metal.

18 Claims, 3 Drawing Sheets

METHOD OF REPAIRING CRACKED CONCRETE

FIELD

The present disclosure relates to a method of repairing cracked concrete.

BACKGROUND

This section provides background information related to the present disclosure which is not necessarily prior art.

Over time, concrete structures can develop cracks due to stresses and strains applied to the concrete structure. Purposes of this disclosure, cracks refer to cracks that occur in failed concrete as opposed to joints that are purposefully formed between separate concrete structures. From commonly owned U.S. Pat. No. 6,692,595, it has been known to repair concrete structures by pasting a reinforcement material over cracks or seams in the concrete structure.

In addition, from commonly owned U.S. Pat. No. 9,528,286, it has been known to repair a crack in a concrete structure by covering a portion of the crack and injecting adhesive directly into the crack.

From commonly owned U.S. Pat. No. 7,823,354 it has been known to repair a crack in concrete by cutting recesses or slots in the concrete on opposite sides of the crack and adhering the legs of a U-shaped or staple-shaped bracket into the recesses with a bridge portion extending between the legs and overtop of the crack. While the above techniques are successful in repairing cracks, there is still a need to provide an improved crack repair method that reduces the amount of reinforcement material needed and that reduces the need for specially manufactured brackets.

SUMMARY

This section provides a general summary of the disclosure, and is not a comprehensive disclosure of its full scope or all of its features.

The present disclosure provides a method of repairing concrete having a crack, comprising: cutting an elongated slot across the crack, the slot having a depth greater than its width; inserting an elongated rigidified fabric grid into the slot to extend across the crack, the rigidified fabric grid having a length dimension greater than a width dimension which is greater than a thickness dimension, the rigidified fabric grid defining a plurality of openings there through that extend toward opposites sides of the slot; and adhering the elongated rigidified fabric grid in the slot with an adhesive that flows into at least some of the plurality of openings.

According to a further aspect of the present disclosure, the rigidified fabric grid includes a plurality of laterally spaced fiber bundles extending in a direction of the length dimension and a plurality of longitudinally spaced fiber bundles in a direction of the width dimension.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Figure 1:
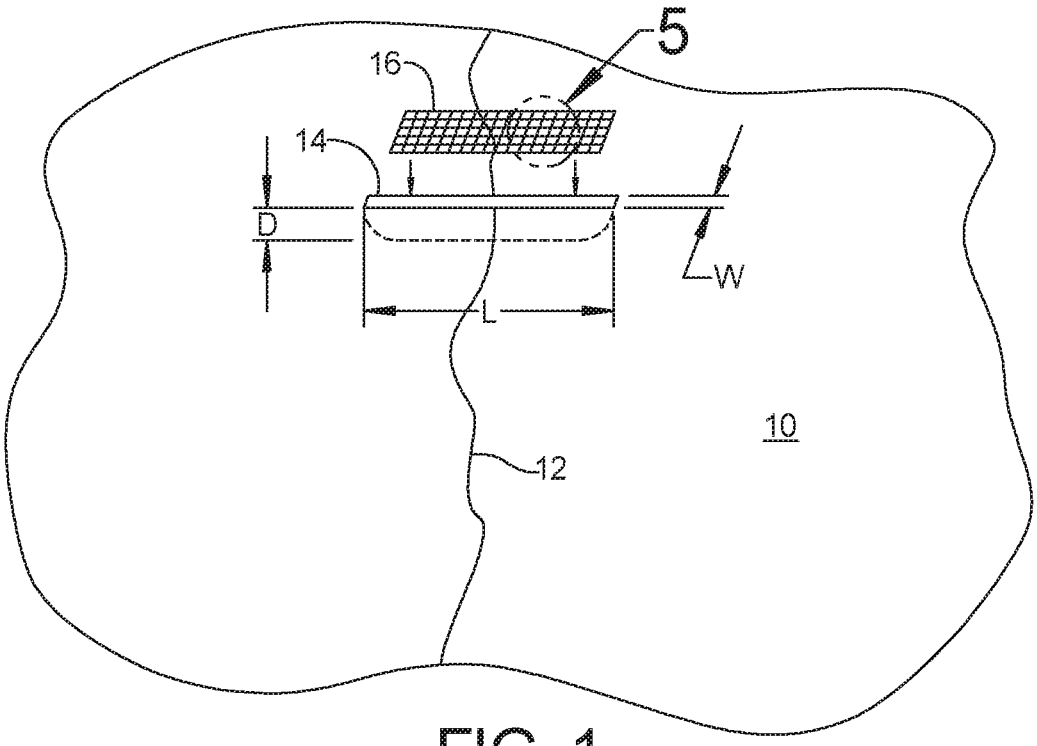
FIG. 1 is a schematic illustration of a method of repairing a crack according to the principles of the present disclosure.

With reference to FIG. 1, the concrete structure 10 is shown including a crack 12 extending therein. The concrete structure 10 can include a concrete slab such as a floor, driveway segment, sidewalk segment, road segment or can include a concrete wall or other concrete support structure. A method according to the principles of the present disclosure includes cutting a slot 14 in the concrete structure 10 across the crack 12. The slot 14 has a length L that can be longer than a depth D that is deeper than a width W of the slot 14.

Figure 2:
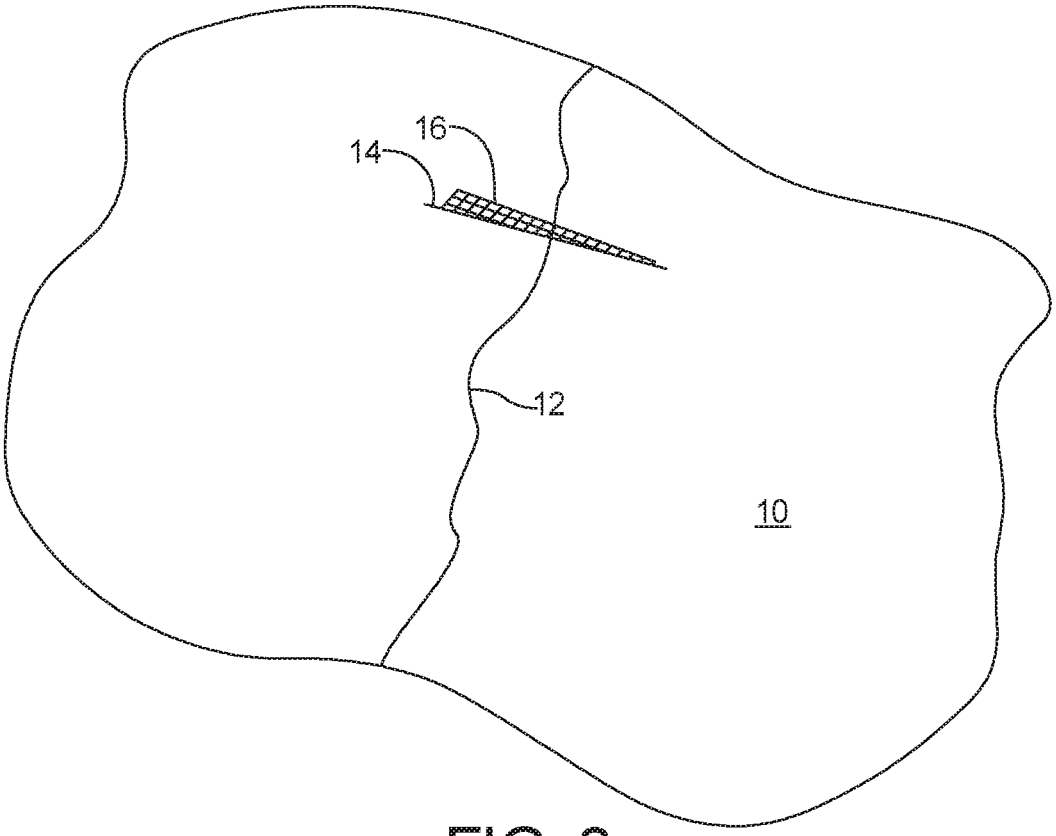
FIG. 2 is a schematic illustration of an elongated rigidified fabric grid into the slot to extend across the crack.
Figure 5:
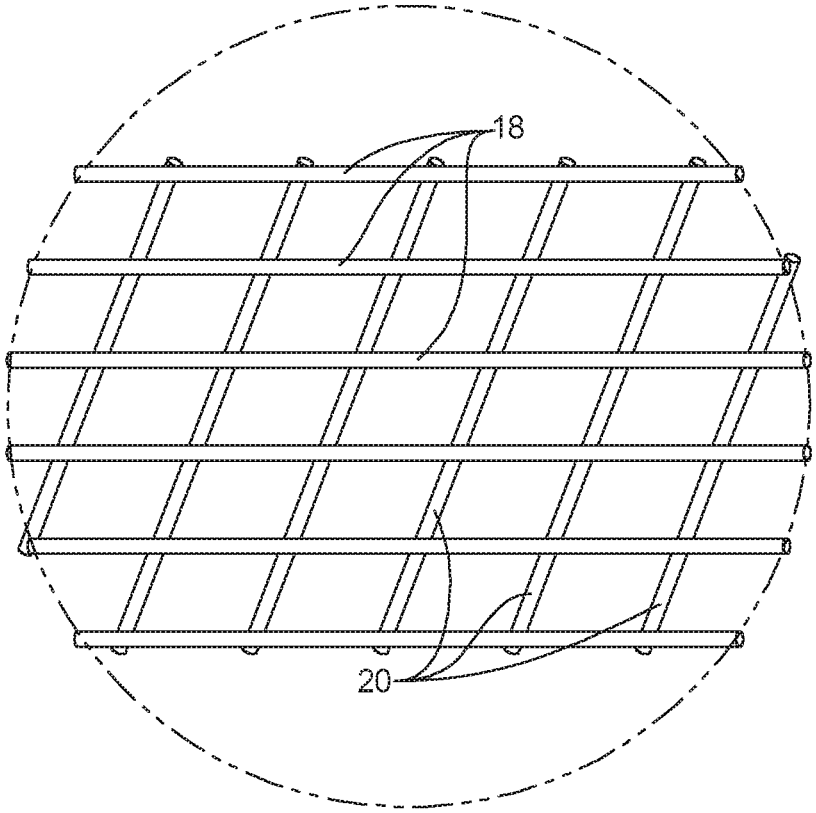
FIG. 5 is a detailed schematic illustration of section 5 of FIG. 1 showing the longitudinal and lateral fiber bundles of the elongated rigidified fabric grid.

An elongated rigidified fabric grid 16 is inserted into the slot 14 to extend across the crack 12, as illustrated in FIG. 2 which shows the grid 16 in a partially inserted state prior to full insertion. The rigidified fabric grid 16 can be sized to have a length (l) less than or substantially equal to the length L of the slot 14 and can have a width (w) that is less than or substantially equal to a depth D of the slot 14 and can have a thickness (t) that is less than or substantially equal to a width W of the slot 14. As best shown in FIG. 5, the elongated rigidified fabric grid 16 includes a plurality of laterally spaced fiber bundles 18 extending in a direction of the length dimension (l) and a plurality of longitudinally spaced fiber bundles 20 extending in a direction of the width dimension (w). The plurality of laterally spaced fiber bundles 18 and the plurality of longitudinally spaced fiber bundles 20 can include carbon fibers, nylon fibers, Kevlar fibers or other non-elastic fibers. According to one embodiment, the plurality of laterally spaced fiber bundles 18 can be made from carbon fibers and the plurality of longitudinally spaced fiber bundles 20 can be made from Kevlar fibers. The elongated rigidified fabric grid can be formed by the methods disclosed in commonly owned US published application 2009/0081913 which is herein incorporated by reference. Alternatively, other forming methods could be used.

The slot 14 can be injected with a liquid adhesive such as an epoxy. The liquid adhesive can be injected either before or after insertion of the elongated rigidified fabric grid 16. In addition, the liquid adhesive can be injected into the crack 12. The plurality of laterally spaced fiber bundles 18 and the plurality of longitudinally spaced fiber bundles 20 define openings there between which permit the liquid adhesive to flow into and through the openings in the rigidified fabric grid 16 so that the liquid adhesive can be evenly distributed on both sides of the rigidified fabric grid 16 and into the crack 12 on both sides of the slot 14 so that the rigidified fabric grid does not act as a dam for preventing flow of the liquid adhesive. In addition, the openings between the plurality of laterally spaced fiber bundles 18 and the plurality of longitudinally spaced fiber bundles 20 increase the surface area for the adhesive to bond to the rigidified fabric grid and after hardening within the openings, the adhesive acts similar to dozens of rivets for preventing the cracked concrete segments from separating further.

Figure 3:
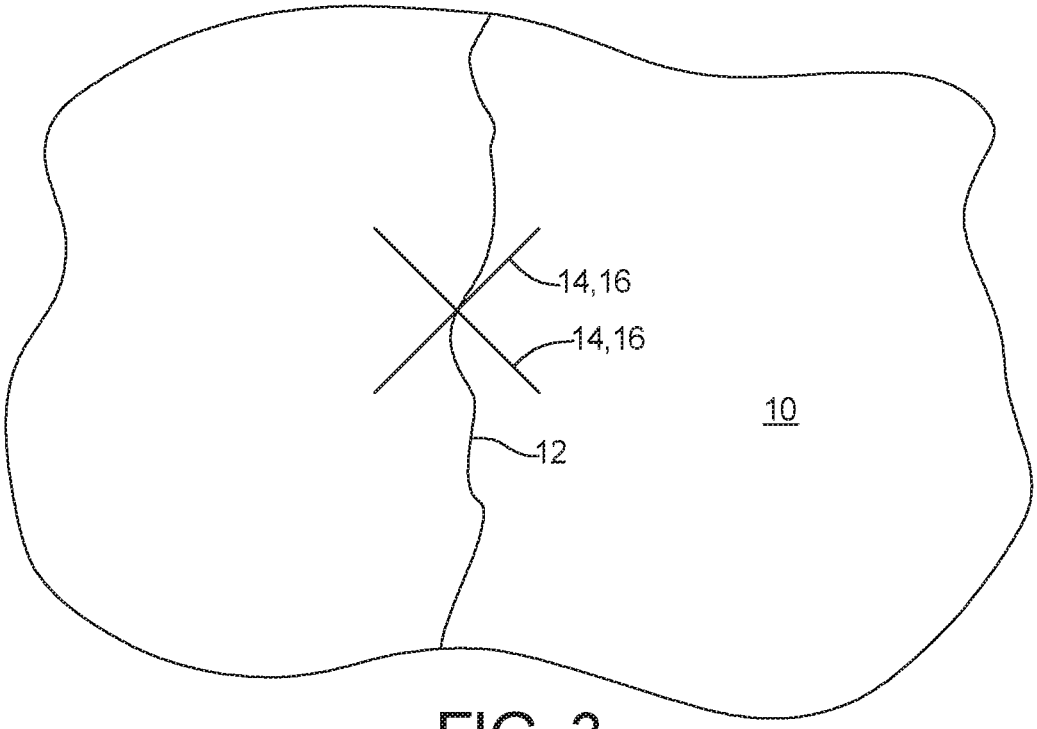
FIG. 3 is a plan view of a concrete structure having a crack repaired according to the principles of the present disclosure.
Figure 4:
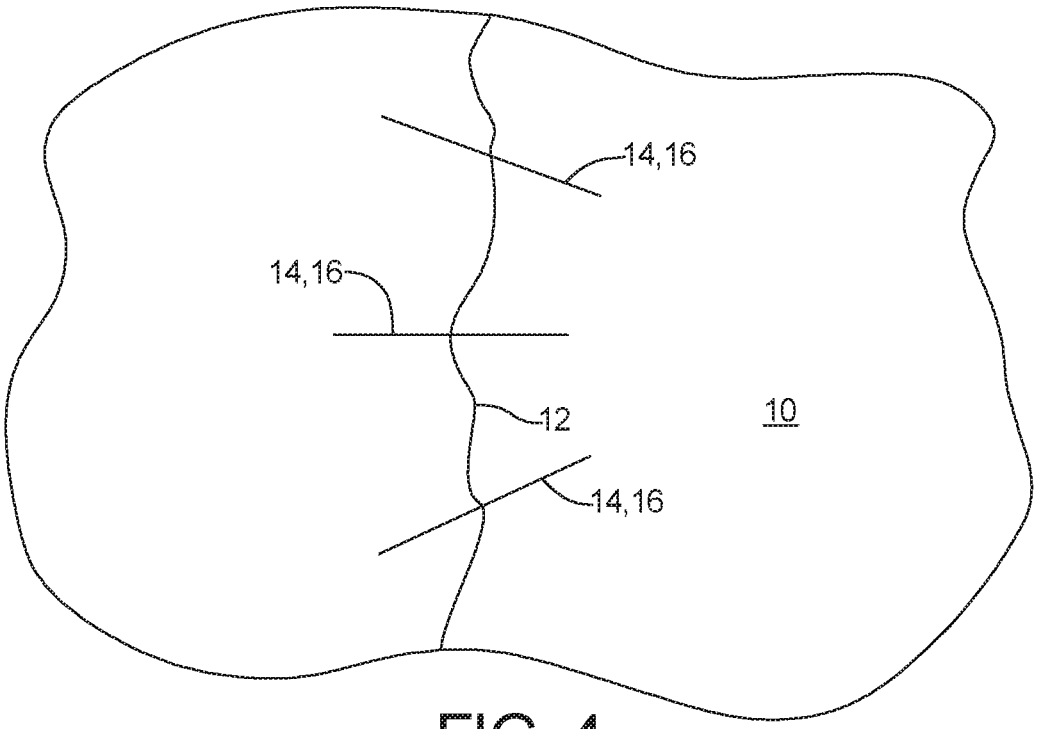
FIG. 4 is a plan view of a concrete structure having a crack repaired according to an alternative method of the present disclosure.

FIGS. 1 and 2 show a single slot 14 and rigidified fabric grid 16 extending across the crack 12. However, as shown in FIG. 3, two slots 14 are cut across the crack 12 in a crisscross manner for each receiving a pair of rigidified fabric grids 16. In this case, one of the slots 14 can be cut deeper than the other so that the rigidified fabric grids 16 do not interfere with one another. As shown in FIG. 4, a plurality of slots 14 are cut across the crack 12 at spaced locations along the crack 12 for each receiving a rigidified fabric grid 16. In this case, the slots 14 can be generally parallel to one another or angled at different angles to resist shearing type movements along the crack 12. Combinations of the above-type of slots 14 can also be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of repairing concrete having a crack, comprising:

cutting an elongated slot across the crack, the slot having a depth greater than a width of the slot;

inserting an elongated rigidified fabric grid into the slot to extend across the crack, the rigidified fabric grid having a length dimension greater than a width dimension which is greater than a thickness dimension, the rigidified fabric grid defining a plurality of openings there through that extend toward opposites sides of the slot; and adhering the elongated rigidified fabric grid in the slot with an adhesive that flows into at least some of the plurality of openings, wherein the rigidified fabric grid includes a plurality of laterally spaced fiber bundles extending in a direction of the length dimension and a plurality of longitudinally spaced fiber bundles in a direction of the width dimension.

2. The method according to claim 1, wherein the plurality of laterally spaced fiber bundles include carbon fibers.

3. The method according to claim 1, wherein the plurality of longitudinally spaced fiber bundles include Kevlar fibers.

4. The method according to claim 1, further comprising cutting an additional elongated slot across the crack and inserting an additional elongated rigidified fabric grid into the additional slot to extend across the crack, the additional rigidified fabric grid having a length dimension greater than a width dimension which is greater than a thickness dimension, the additional rigidified fabric grid defining a plurality of openings there through that extend toward opposites sides of the additional slot; and adhering the additional elongated rigidified fabric grid in the additional slot with a liquid adhesive that flows into at least some of the plurality of openings.

5. The method according to claim 4, wherein the slot and the additional slot intersect one another.

6. The method according to claim 4, wherein the rigidified fabric grid includes a plurality of laterally spaced fiber bundles extending in a direction of the length dimension and a plurality of longitudinally spaced fiber bundles in a direction of the width dimension.

7. The method according to claim 6, wherein the plurality of laterally spaced fiber bundles include carbon fibers.

8. The method according to claim 4, wherein the slot and the additional slot intersect the crack at different spaced locations.

9. The method according to claim 8, wherein the rigidified fabric grid and the additional rigidified fabric grid each include a plurality of laterally spaced fiber bundles extending in a direction of the length dimension and a plurality of longitudinally spaced fiber bundles in a direction of the width dimension.

10. The method according to claim 9, wherein the plurality of laterally spaced fiber bundles include carbon fibers.

11. The method according to claim 1, wherein the adhesive flows into the crack.

12. A method of repairing concrete having a crack, comprising:

cutting an elongated slot across the crack, the slot having a depth greater than a width of the slot;

inserting an elongated rigid grid into the slot to extend across the crack, the rigid grid having a length dimension greater than a width dimension which is greater than a thickness dimension, the rigid grid defining a plurality of openings there through that extend toward opposites sides of the slot; and adhering the elongated rigid grid in the slot with an adhesive that flows into at least some of the plurality of openings, wherein the rigid grid includes a plurality of laterally spaced fiber bundles extending in a direction of the length dimension and a plurality of longitudinally spaced fiber bundles in a direction of the width dimension.

13. The method according to claim 12, wherein the plurality of laterally spaced fiber bundles include carbon fibers.

14. The method according to claim 12, wherein the plurality of longitudinally spaced fiber bundles include Kevlar fibers.

15. The method according to claim 12, further comprising cutting an additional elongated slot across the crack and inserting an additional elongated rigid grid into the additional slot to extend across the crack, the additional rigid grid having a length dimension greater than a width dimension which is greater than a thickness dimension, the additional rigid grid defining a plurality of openings there through that extend toward opposites sides of the additional slot; and adhering the additional elongated rigid grid in the additional slot with a liquid adhesive that flows into at least some of the plurality of openings.

16. The method according to claim 15, wherein the slot and the additional slot intersect one another.

17. The method according to claim 12, wherein the rigid grid is made from a wire mesh.

18. The method according to claim 12, wherein the rigid grid is made from metal.

* * * * *